US010373542B2

(12) United States Patent
Jung et al.

(10) Patent No.: US 10,373,542 B2
(45) Date of Patent: Aug. 6, 2019

(54) METHOD AND APPARATUS FOR DISPLAYING AN IMAGE

(71) Applicant: SAMSUNG DISPLAY CO., LTD., Yongin-si, Gyeonggi-do (KR)

(72) Inventors: Hae Goo Jung, Yongin-si (KR); Jae Woo Song, Yongin-si (KR); Jae Hoon Lee, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 76 days.

(21) Appl. No.: 15/372,444

(22) Filed: Dec. 8, 2016

(65) Prior Publication Data

US 2017/0169750 A1 Jun. 15, 2017

(30) Foreign Application Priority Data

Dec. 11, 2015 (KR) ..... 10-2015-0176635

(51) Int. Cl.
*G09G 3/20* (2006.01)
*G09G 3/3258* (2016.01)

(52) U.S. Cl.
CPC ..... *G09G 3/2003* (2013.01); *G09G 3/3258* (2013.01); *G09G 2300/0452* (2013.01); *G09G 2320/0242* (2013.01); *G09G 2320/0646* (2013.01)

(58) Field of Classification Search
CPC ..... G09G 3/2003; G09G 3/3258; G09G 2320/0233; G09G 2320/0238; G09G 2320/0242
See application file for complete search history.

(56) References Cited

U.S. PATENT DOCUMENTS

| | | | | |
|---|---|---|---|---|
| 8,022,900 | B2 | 9/2011 | Koh et al. | |
| 8,847,940 | B2 * | 9/2014 | Chung | G09G 5/00 345/211 |
| 2007/0126671 | A1 * | 6/2007 | Naoaki | G09G 3/3225 345/77 |
| 2008/0170014 | A1 * | 7/2008 | Jung | G09G 3/3233 345/82 |
| 2012/0038684 | A1 * | 2/2012 | Ryu | G09G 3/20 345/690 |
| 2013/0162622 | A1 * | 6/2013 | Ebisuno | G09G 3/3208 345/212 |

(Continued)

FOREIGN PATENT DOCUMENTS

| | | |
|---|---|---|
| KR | 10-2007-0052509 A | 5/2007 |
| KR | 10-2011-0055303 A | 5/2011 |
| KR | 10-2015-0019341 A | 2/2015 |

*Primary Examiner* — Sardis F Azongha
(74) *Attorney, Agent, or Firm* — Lee & Morse, P.C.

(57) ABSTRACT

In order to display an image in a display device, in which a plurality of sub pixels within a unit pixel receives driving power from one driving power line, a driving voltage stability weak pattern is detected by analyzing image data. When the input image is determined as the driving voltage stability weak pattern, a white balance correction gain of each sub pixel is decreased while a ratio among the white balance correction gains of the sub pixels is maintained. Target luminance for displaying the input image is changed. A voltage level of the driving power is change in accordance with the changed target luminance.

20 Claims, 10 Drawing Sheets

(56) References Cited

U.S. PATENT DOCUMENTS

| | | | | |
|---|---|---|---|---|
| 2014/0368551 | A1* | 12/2014 | Chan | G09G 3/2003 345/690 |
| 2015/0009242 | A1* | 1/2015 | Park | G09G 3/3233 345/690 |
| 2015/0049133 | A1 | 2/2015 | Choi et al. | |
| 2016/0155382 | A1* | 6/2016 | Cheon | G09G 3/3233 345/690 |
| 2016/0180815 | A1* | 6/2016 | Pyo | G09G 3/2022 345/213 |

* cited by examiner

| TARGET LUMINANCE | 100% | 100% | 90% | 100% | 70% |
|---|---|---|---|---|---|
| ELVDP | 7.2V | 9.4V | 8.3V | 11.6V | 9.1V |

| TARGET LUMINANCE | 100% | 100% | 70% | 100% | 70% |
|---|---|---|---|---|---|
| ELVDP | 7.2V | 9.4V | 7.3V | 11.6V | 9.1V |

METHOD AND APPARATUS FOR DISPLAYING AN IMAGE

CROSS-REFERENCE TO RELATED APPLICATION

Korean Patent Application No. 10-2015-0176635, filed on Dec. 11, 2015, in the Korean Intellectual Property Office, and entitled: "Method and Apparatus for Displaying Image," is incorporated by reference herein in its entirety.

BACKGROUND

1. Field

The present disclosure relates to a method and an apparatus for displaying an image.

2. Description of the Related Art

Recently, light weight and thinness of displays have been demanded. Accordingly, cathode ray tubes (CRTs) have been replaced by liquid crystal displays (LCDs). However, LCDs require a separate backlight, and has many problems in a response rate, a viewing angle, and the like.

Organic light emitting diode (OLED) displays may overcome these limitations. OLED displays are self-emissive, i.e., do not require a separate light source. OLED displays provide reduced power consumption, and increased response rate, viewing angle, and contrast ratio.

OLED devices include two electrodes and an emission layer positioned therebetween. Electrons injected from one electrode and holes injected from the other electrode are combined in the emission layer to form excitons, which emit light while discharging energy. In a general case, sub pixels displaying red, green, and blue are connected to power lines, which are independent from each other, and driven. Recently, in order to solve a color deviation phenomenon, a method of connecting sub pixels of red, green, and blue to one combined power line and driving the sub pixels has been used.

SUMMARY

An exemplary embodiment of the present disclosure provides a method of displaying an image in a display device, in which a plurality of sub pixels within a unit pixel receives driving power from one driving power line, the method including: analyzing image data and detecting a driving voltage stability weak pattern; when the input image is determined as the driving voltage stability weak pattern, decreasing a white balance correction gain of each sub pixel while maintaining a ratio among the white balance correction gains of the sub pixels; changing target luminance for displaying the image data; and changing a voltage level of the driving power in accordance with the changed target luminance.

Detecting the driving voltage stability weak pattern may include measuring a voltage change of the driving power supplied to the sub pixels within the unit pixel while displaying the image data, and determining the image data as the driving voltage stability weak pattern when a range of the voltage change is equal to or larger than a predetermined specific value.

Detecting the driving voltage stability weak pattern may include: dividing the image data into a plurality of blocks; calculating a sum of an image load of each of the plurality of blocks; and when a deviation to the sum of the image load calculated for each block is equal to or larger than a predetermined value, determining the image data as the driving voltage stability weak pattern.

Decreasing the white balance correction gain of each sub pixel may include multiplying the white balance correction gains of the sub pixels and the same factor value.

An emission period, for which an emission device of each sub pixel emits light within one frame period, may be decreased by decreasing the white balance correction gain.

The factor value may be a number larger than 0 and smaller than 1.

Changing the target luminance for displaying the image data may include decreasing the target luminance generated by the image data.

Changing the voltage level of the driving power in accordance with the changed target luminance may include decreasing the voltage level in accordance with the decreased target luminance.

The sub pixels may include a red sub pixel, a green sub pixel, and a blue sub pixel.

Another exemplary embodiments of the present disclosure provides a display device, including: a display panel including a plurality of unit pixels, in which a plurality of sub pixels within the unit pixel receives driving power from the same driving power line; a weak pattern detector configured to analyze image data, and determine whether the image data is a driving voltage stability weak pattern; a white balance corrector configured to change white balance correction gains applied to the sub pixels based on a result of the determination of the weak pattern detector, and change target luminance of the image data; and a driving power adjustor configured to change a voltage level applied to the driving power line within the display panel based on the changed target luminance.

The weak pattern detector may detect the voltage level of the driving line while the image data is displayed on the display panel, and determine the image data as a driving voltage stability weak pattern when a variation range of the voltage level according to a time is equal to or larger than a predetermined specific value.

The weak pattern detector may divide the image data into a plurality of blocks, calculate a sum of an image data load for each of the plurality of blocks, and determine the image data as the driving voltage stability weak pattern when a deviation to the sum of the image data load for each block is equal to or larger than a predetermined specific value.

The white balance corrector may multiply the white balance correction gains applied to the sub pixels and the same factor value.

The white balance corrector may decrease target luminance of the image data together with multiplying the white balance correction gains and the same factor value.

The driving power adjustor may change a voltage level applied to the driving power line within the display panel based on the decreased target luminance.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
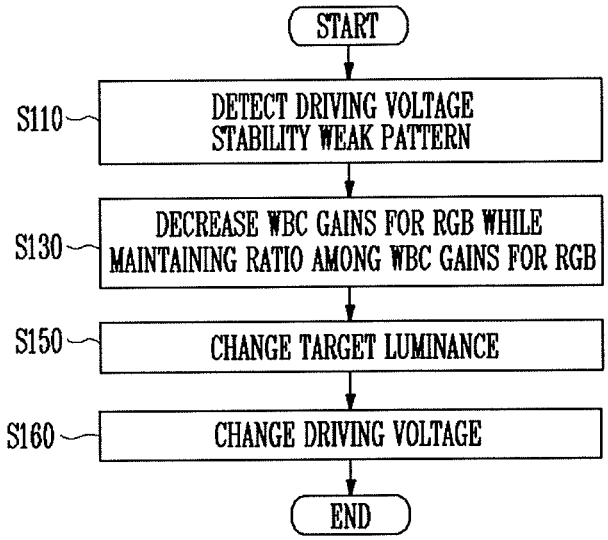
FIG. 1 illustrates a flowchart of an image displaying method according to an exemplary embodiment of the present disclosure.

Hereinafter, exemplary embodiments of the present disclosure will be described in detail with reference to the accompanying drawings. In this case, it should be noted that the same elements will be designated by the same reference numerals in the accompanying drawings. In the description below, it should be noted that only parts necessary for understanding operations according to various exemplary embodiments of the present disclosure will be described, and descriptions of other parts may be omitted so as to avoid unnecessarily obscuring the subject matter of the present disclosure. However, the present disclosure is not limited to the exemplary embodiments described herein, and may be implemented in various different forms. However, the exemplary embodiments described herein are provided so as to describe the present disclosure in detail so that those skilled in the art may easily carry out the technical spirit of the present disclosure.

FIG. 1 is a flowchart illustrating an image displaying method according to an exemplary embodiment of the present disclosure.

Referring to FIG. 1, the image displaying method according to the exemplary embodiment of the present disclosure displays an image on a display device, in which a plurality of sub pixels within a unit pixel receives driving power from one driving power line. The image display method includes an operation S110 of detecting a driving voltage stability weak pattern by analyzing image data, an operation S130 of decreasing a white balance correction gain of each sub pixel while maintaining a ratio among the white balance correction gains of the sub pixels, an operation S150 of changing target luminance for displaying the image data, and an operation S170 of changing a voltage level of the driving power in response to the changed target luminance.

In operation S110, it is determined whether the image data includes a pattern, in which a variation range of a voltage level of the driving power for a one frame period is high. According to a pattern of the received image, the voltage level supplied through a driving power line connected to each of the unit pixels within the display device may be changed within the one frame period. For example, in a case of the image pattern illustrated in FIG. 7, a variation range of the voltage level of the driving power for the one frame period may be high. A particular method of detecting the driving voltage stability weak pattern will be described below.

In operation S130, white balance correction gains applied to sub pixels of the whole unit pixels displaying the 1 frame are decreased by the same ratio for the sub pixels. In the operation S130, in order to decrease the white balance correction gains by the same ratio for the sub pixels, already set white balance correction gains of the sub pixels may be multiplied by the same factor value. The factor value may be a number larger than 0 and smaller than 1.

In operation S150, target luminance corresponding to the image data is changed. Particularly, in operation S150, the target luminance may be decreased. In operation S130, the white balance correction gain applied to each of the sub pixels is decreased, so that luminance of an image displayed on a screen of the display device is also decreased based on the image data under the same condition. The target luminance corresponding to the image data is separately determined from the white balance correction gain. Accordingly, when the white balance correction gain applied to each of the sub pixels is decreased, in order to achieve the determined target luminance, a voltage level of the driving power applied to each pixel may be increased. In order to make the voltage level of the driving power be within an adjustable range, the target luminance may be changed. That is, it is possible to prevent the voltage level of the driving power from being excessively increased by decreasing the target luminance by decreasing the white balance correction gain and decreasing the target luminance together.

In operation S170, the voltage level of the driving power is changed based on the decreased target luminance.

Figure 2:
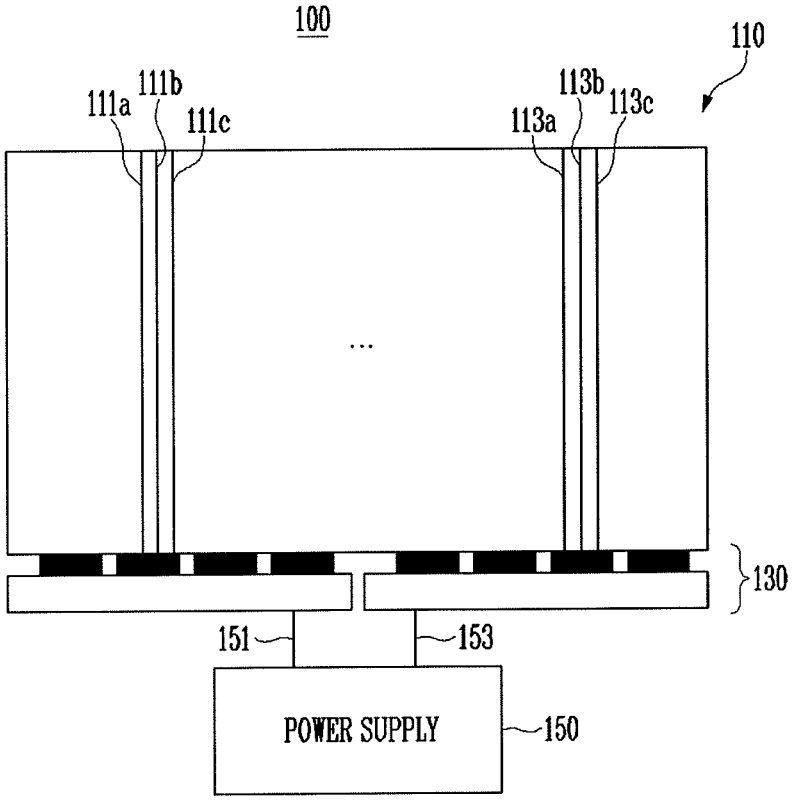
FIG. 2 illustrates a schematic diagram of a display device, in which sub pixels within a unit pixel are connected to different power lines and driven.

FIG. 2 is a schematic diagram of a display device in which sub pixels within a unit pixel are connected to different power lines and driven. Referring to FIG. 2, a display device 100 includes a display panel 110, a driving integrated circuit (IC) 130, and a power supply unit 150.

The display panel 110 includes a plurality of unit pixels (not illustrated) for displaying an image. Each of the unit pixels includes a plurality of sub pixels. Further, the display panel 110 includes a first driving power line 111*a*, a second driving power line 111*b*, and a third driving power line 111*c*. The first driving power line 111*a*, the second driving power line 111*b*, and the third driving power line 111*c* may be connected to one unit pixel. Further, each of the first driving power line 111*a*, the second driving power line 111*b*, and the third driving power line 111*c* may be connected to sub pixels displaying different colors. For example, the first driving power line 111*a* may be connected to red sub pixels of unit pixels included in a corresponding first pixel column. The second driving power line 111*b* may be connected to green sub pixels of the unit pixels included in the corresponding first pixel column. The third driving power line 111*c* may be connected to blue sub pixels of the unit pixels included in the corresponding first pixel column.

Similarly, the display panel 110 may include a fourth driving power line 113*a*, a fifth driving power line 113*b*, and a sixth driving power line 113*c*. The fourth driving power line 113*a*, the fifth driving power line 113*b*, and the sixth driving power line 113*c* may be connected to one unit pixel. Further, each of the fourth driving power line 113*a*, the fifth driving power line 113*b*, and the sixth driving power line 113*c* may be connected to sub pixels displaying different colors. For example, the fourth driving power line 113*a* may be connected to red sub pixels of unit pixels included in a corresponding second pixel column. The fifth driving power line 113*b* may be connected to green sub pixels of the unit pixels included in the corresponding second pixel column. The sixth driving power line 113*c* may be connected to blue sub pixels of the unit pixels included in the corresponding second pixel column.

As described above, the sub pixels within the unit pixel included in the display panel 110 may be connected to the different driving power lines. A connection relation between the sub pixels within the unit pixel and the power line in the display panel illustrated in FIG. 2 will be described in more detail with reference to FIG. 3.

In the meantime, the driving IC 130 may control an operation of the display panel 110. Further, the power supply unit 150 may supply power to the driving IC and the display panel 110 through power supply lines 151 and 153.

Figure 3:
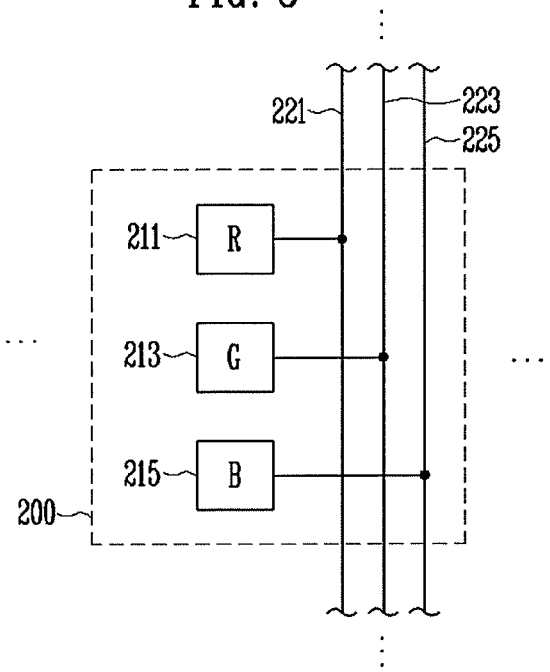
FIG. 3 illustrates a schematic diagram of a connection relation between the sub pixels within the unit pixel and the power lines in the display device of FIG. 2.

FIG. 3 is a schematic diagram of a connection relation between the sub pixels within the unit pixel and the power lines in the display device of FIG. 2. Referring to FIG. 3, a unit pixel 300 includes a red sub pixel 211, a green sub pixel 213, and a blue sub pixel 215. Further, the unit pixel 200 is connected with a first power supply line 221, a second power supply line 223, and a third power supply line 225. Particularly, the red sub pixel 211 is connected to the first power supply line 221, the green sub pixel 213 is connected to the second power supply line 223, and the blue sub pixel 215 is connected to the third power supply line 225.

Operation characteristics of the devices displaying red, green, and blue, respectively, may be different. For example, emission efficiency of the devices displaying red, green, and blue, respectively, may be different. In this case, even though the same voltage is applied, the degrees of emission of the devices displaying red, green, and blue are different. As illustrated in FIGS. 2 and 3, the power supply lines may be separately connected to the sub pixels, operation points may be separately adjusted according to characteristics of the sub pixels. That is, it is possible to exhibit an accurate color by adjusting a power voltage applied to each of the first power supply line 221, the second power supply line 223, and the third power supply line 225 according to emission efficiency of the devices displaying red, green, and blue. However, recently, in order to solve a color deviation phenomenon, a method of connecting sub pixels of red, green, and blue to one combined power line and driving the sub pixels is also used.

Figure 4:
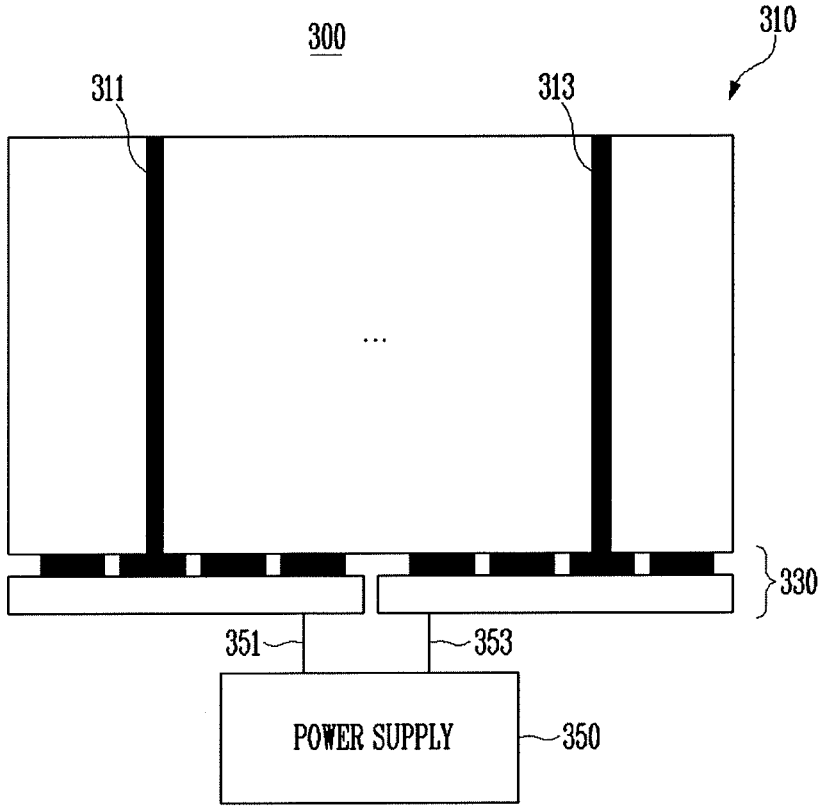
FIG. 4 illustrates a display device in which sub pixels within a unit pixel are connected to the same power line and driven.

FIG. 4 is a diagram schematically illustrating a display device, in which sub pixels within a unit pixel are connected to the same power line and driven. Referring to FIG. 4, a display device 300 includes a display panel 310, a driving integrated circuit (IC) 330, and a power supply unit 350.

The display panel 310 includes a plurality of unit pixels for displaying an image. Each of the unit pixels includes a plurality of sub pixels. Further, the display panel 110 includes a first driving power line 311 and a second driving power line 313. The first driving power line 311 may be connected to one unit pixel. Further, the first driving power line 311 may be simultaneously connected to sub pixels displaying different colors within one unit pixel. For example, the first driving power line 311 may be connected to red sub pixels, green sub pixels, and blue sub pixels of unit pixels included in a corresponding first pixel column.

Similarly, the second driving power line 313 may be connected to one unit pixel. Further, the second driving power line 313 may be simultaneously connected to sub pixels displaying different colors within one unit pixel. For example, the second driving power line 313 may be connected to red sub pixels, green sub pixels, and blue sub pixels of unit pixels included in a corresponding second pixel column.

As described above, the sub pixels within the unit pixel included in the display panel 310 may be connected to the same driving power line. A connection relation between the sub pixels within the unit pixel and the power line in the display panel illustrated in FIG. 4 will be described in more detail with reference to FIG. 5.

In the meantime, the driving IC 330 may control an operation of the display panel 310. Further, the power supply unit 350 may supply power to the driving IC 330 and the display panel 310 through power supply lines 351 and 353.

Figure 5:
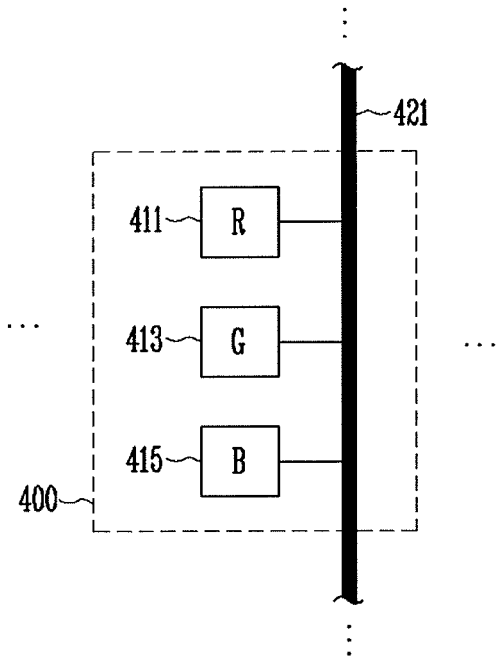
FIG. 5 illustrates a schematic diagram of a connection relation between the sub pixels within the unit pixel and the power line in the display device of FIG. 4.

FIG. 5 is a schematic diagram of a connection relation between the sub pixels within the unit pixel and the power line in the display device of FIG. 4. Referring to FIG. 5, a unit pixel 400 includes a red sub pixel 411, a green sub pixel 413, and a blue sub pixel 415. Further, the unit pixel 400 is connected with one power supply line 421. Particularly, all of the red sub pixel 411, the green sub pixel 413, and the blue sub pixel 415 are connected to the power supply line 421.

As described above, the devices displaying red, green, and blue may have different efficiency, and in this case, even though the same voltage is applied, the degrees of emission of the devices displaying red, green, and blue are different. Accordingly, when the sub pixels within the unit pixel are connected to the same power supply line as illustrated in FIGS. 4 and 5, a procedure and a configuration for correcting white balance are required. The reason why the correction of the white balance is required when the sub pixels within the unit pixel are connected to the same power supply line will be described below with reference to the graph of FIG. 6.

Figure 6:
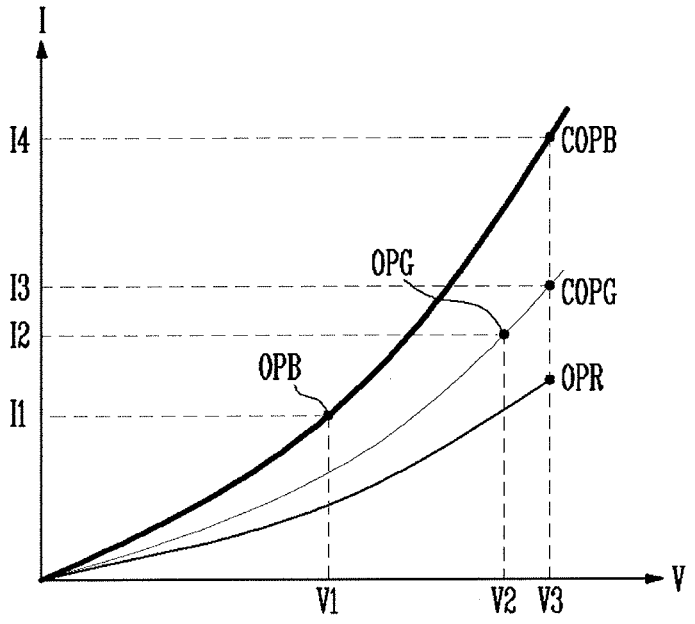
FIG. 6 illustrates a graph for describing a white balance correction in a case where sub pixels are connected to the same power line.

FIG. 6 is a graph for describing a white balance correction in a case where sub pixels are connected to the same power line. Referring to FIG. 6, a voltage-current characteristic graph for red, green, and blue devices is illustrated. The voltage-current characteristic graph for a red device is a curve line connecting a starting point and a red operation point OPR, the voltage-current characteristic graph for a green device is a curve line connecting a starting point, an green operation point OPG, and a changed green operation point COPG, and the voltage-current characteristic graph for a blue device is a curve line connecting a starting point, a blue operation point OPB, and a changed blue operation point COPB.

As illustrated in FIGS. 2 and 3, the power supply lines are separately connected to the sub pixels, operation points may be separately adjusted according to characteristics of the sub pixels. For example, when the target operation points of the red device, the green device, and the blue device are the OPR, the OPG, and the OPB, respectively, a voltage V3 may be applied to the red device, a voltage V2 may be applied to the green device, and a voltage V1 may be applied to the blue device through the separately connected driving power lines.

However, as illustrated in FIGS. 4 and 5, when one power supply line is connected to the sub pixels, the separate voltage adjustment cannot be used. In the graph illustrated in FIG. 6, when the voltage V3 is applied to the power supply line based on the operation point of the red device, the green device is operated at the COPG, so that a current 13 flows, and the blue device is operated at the COPB, so that a current 14 flows. The COPG and the COPB are the different operation points from the original operation points OPG and OPB, so that in order to correct the difference, a white balance correction is required. That is, emission duties of the green sub pixel and the blue sub pixel, in which a more excessive current flows than that of the target operation point, within a 1 frame are multiplied by white balance correction gains.

According to the graph of FIG. 6, when the voltage level V3 is applied to the driving power line, a white balance correction gain of 1 is multiplied for the red sub pixel, a white balance correction gain of I2/I3 is multiplied for the green sub pixel, and a white balance correction gain of I1/I4 is multiplied for the green sub pixel, thereby obtaining the similar effects to those of the operations at the OPR, the OPG, and the OPB. However, even though the white balance correction, in a case of an image including a specific pattern, a color deviation may be still generated by a variation of a voltage level of the driving power.

Figure 7:
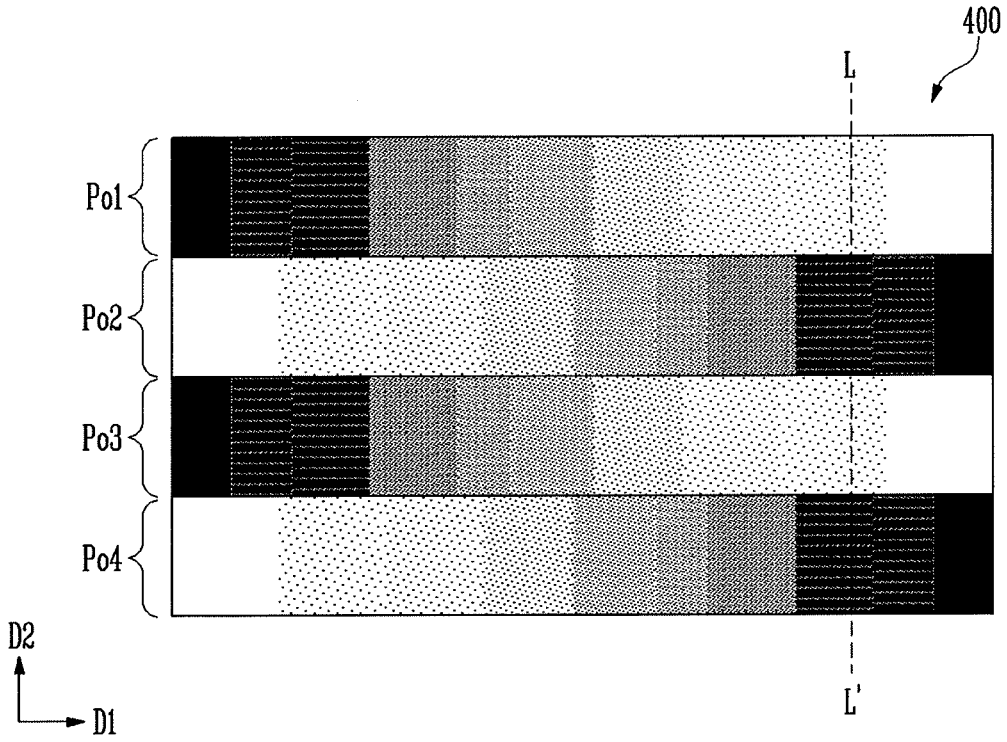
FIG. 7 illustrates a representative image corresponding to a driving voltage stability weak pattern.

FIG. 7 is a diagram illustrating a representative image corresponding to a driving voltage stability weak pattern.

Referring to FIG. 7, an image 400 includes a four stage lamp having a ramp pattern of four stages in a direction D2. For convenience of the description, it is assumed that the ramp pattern illustrated in FIG. 7 is a gray scale lamp pattern. The first stage Po1 within the image 400 is a ramp pattern in which luminance gradually increases from a left side to a right side along a direction D1. The second stage Po2 within the image 400 is a ramp pattern in which luminance gradually decreased from the left side to the right side along the direction D1. The third stage Po3 within the image 400 is a ramp pattern in which luminance gradually increases from the left side to the right side along the direction D1. The fourth stage Po4 within the image 400 is a ramp pattern in which luminance gradually decreases from the left side to the right side along the direction D1.

In a case of the image illustrated in FIG. 7, even though the white balance correction described with reference to FIG. 6, a color deviation may be generated in a specific region, for example, a surrounding region of line L-L' within the image. The reason for the generation of the color deviation will be described with reference to FIG. 8, which is a diagram illustrating an emission operation of pixels in line L-L' within the image of FIG. 7, and a change in a voltage level of driving power according to a time.

Figure 8:
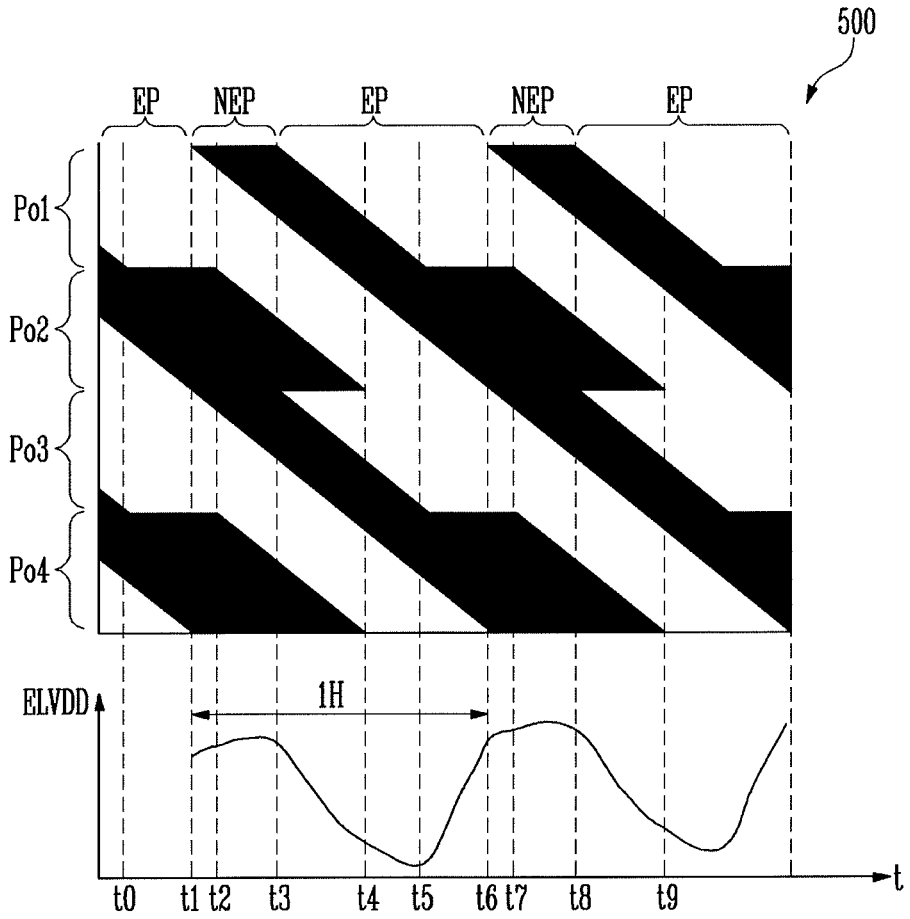
FIG. 8 illustrates an emission operation of pixels in line L-L' within an image of FIG. 7, and a change in a voltage level of driving power according to a time.

At an upper end of FIG. 8, an emission operation of the pixels in the line L-L' within the image of FIG. 7 is illustrated. More particularly, an emission operation of a single pixel column positioned along the line L-L' of FIG. 7 is illustrated over time t. In FIG. 8, an emission period EP of each pixel is a white and a non-emission period NEP is black. Pixels in first and third stages Po1 and Po3 exhibit relatively higher luminance than that of the pixels in second and fourth stages Po2 and Po4. In particular, pixels in Po1 and Po3 include the relatively long emission period EP and the relatively short non-emission period NEP. Further, pixels in Po2 and Po4 include the relatively short emission period EP and the relatively long non-emission period NEP.

A power voltage ELVDD of the driving power line over time will be described. A level of the power voltage ELVDD for a 1 horizontal period 1H is varied. This is because an IR drop value in each period is varied according to a time. For example, on a time axis from a time t0 to a time t9, a relative front period t1 to t3 for one horizontal period will be referred. For the period t1 to t3, a percentage of the pixels operating in the non-emission period among the total pixels is relatively large. Accordingly, the IR-drop of the power voltage ELVDD is small, so that a relatively high power voltage ELVDD value may be maintained. Referring to a period t4 to t5, a percentage of the pixels existing in the emission period among the total pixels arranged in the vertical direction is large. Accordingly, the IR-drop of the power voltage ELVDD is large, the power voltage ELVDD is dropped with a relatively large range. As described above, when a variation range of the power voltage ELVDD for the one horizontal period is large, emission duties of the sub pixels are different, so that influences on the sub pixels by the variation of the power voltage ELVDD are different.

For example, a case in which the white balance correction, the red sub pixel of any one pixel in the first stage Po1 emits light for a period t3 to t6, the green sub pixel emits light for a period t4 to t6, and the blue sub pixel emits light for a period t5 to t6 will be considered. The red sub pixel is driven by the power voltage ELVDD which gradually decreases for the period t3 to t5 and gradually increases for the period t5 to t6. The green sub pixel is driven by the power voltage ELVDD which gradually decreases for the period t4 to t5 and gradually increases for the period t5 to t6. The blue sub pixel is driven by the power voltage ELVDD which gradually increases for the period t5 to t6. However, the white balance correction is originally performed on an assumption that the power voltage ELVDD is maintained in a uniform level. Accordingly, when the power voltage ELVDD is varied for the one horizontal period 1H as described above, a ratio of the quantity of emission of each sub pixel is different, so that a color deviation is generated. The color deviation may be generated for image data including a pattern, in which a luminance deviation within a specific region (for example, the surrounding region of line L-L') is large as illustrated in FIG. 7.

In the case of the present disclosure, in the above pattern, a white balance correction gain of each sub pixel is decreased while a ratio among the white balance correction gains of the red, green, and blue sub pixels is maintained. Accordingly, a color deviation phenomenon may be solved by making the three sub pixels from being more similarly influenced by the varied power voltage ELVDD.

Figure 9A:
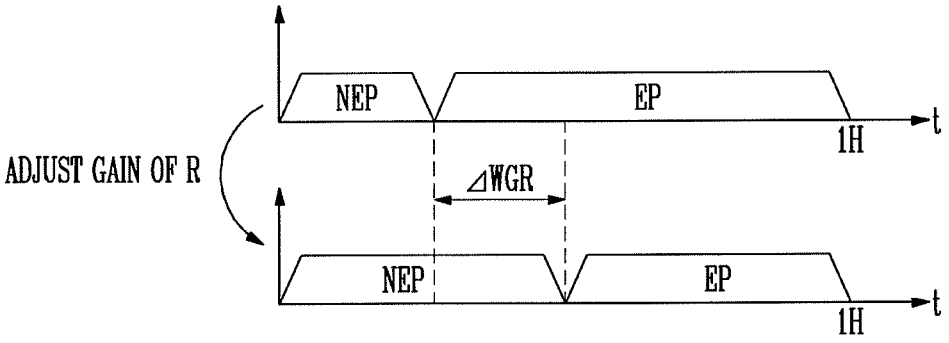
FIGS. 9A, 9B, and 9C illustrate diagrams of a particular method of changing a white balance correction gain of sub pixels according to an exemplary embodiment of the present disclosure.
Figure 9B:
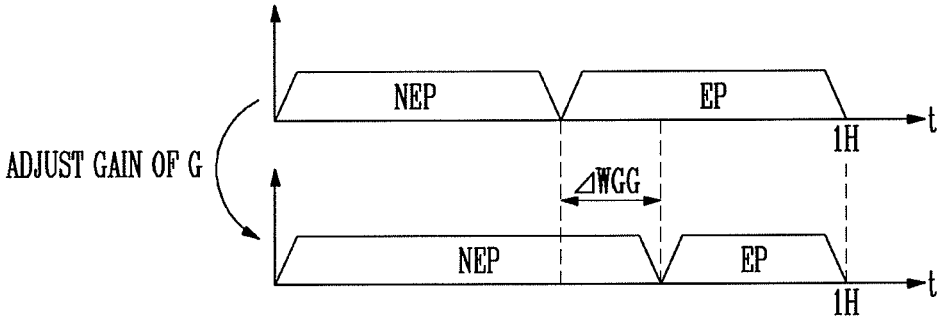
Figure 9C:
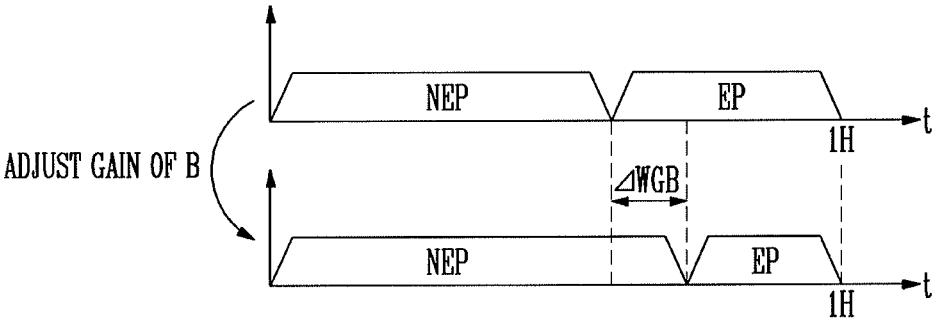

FIGS. 9A, 9B, and 9C are diagrams illustrating a particular method of changing a white balance correction gain of sub pixels according to an exemplary embodiment of the present disclosure. As may be seen therein, the decreased emission periods may be decreased by different amounts, e.g., a longest emission period may be decreased the most, while the emission periods after the white balance correction gains have a same descending order. For example, the red sub pixel may have a longest emission period before and after the white balance correction gain, while the blue sub pixel may have a shortest emission period before and after the white balance correction gain, even though white balance correction gain is larger for the red sub pixel than the blue sub pixel. In other words, the ratio is maintained before and after white balance correction gains are applied.

FIG. 9A illustrates a change in a white balance correction gain of a red sub pixel. That is, an emission period before white balance correction gain is less than that after the white balance correction gain. The decreased emission period is ΔWGR.

FIG. 9B illustrates a change in a white balance correction gain of a green sub pixel. That is, an emission period before white balance correction gain is less than that after the white balance correction gain. The decreased emission period of the green sub pixel is ΔWGG.

FIG. 9C illustrates a change in a white balance correction gain of a blue sub pixel. That is, an emission period before white balance correction gain is less than that after the white balance correction gain. The decreased emission period of the blue sub pixel is ΔWGB.

In the case of the present disclosure, the ratio among the white balance correction gains is maintained, so that a relation expressed by Equation 1 below may be drawn.

$$(CEPR/EPR)=(CEPG/EPG)=(CEPB/EPB)=R \quad (1)$$

In the above Equation, EPR, EPG, and EPB are emission periods of the red, green, and blue sub pixels before the change in the white balance correction gain, respectively, and CEPR, CEPG, and CEPB are corrected emission periods of the red, green, and blue sub pixels after the change in the white balance correction gain, respectively. Accordingly, the white balance correction gains may be changed by multiplying the white balance correction gains of the red, green, and blue sub pixels and a factor R. A value of the factor R is a number larger than 0 and smaller than 1.

Figure 10:
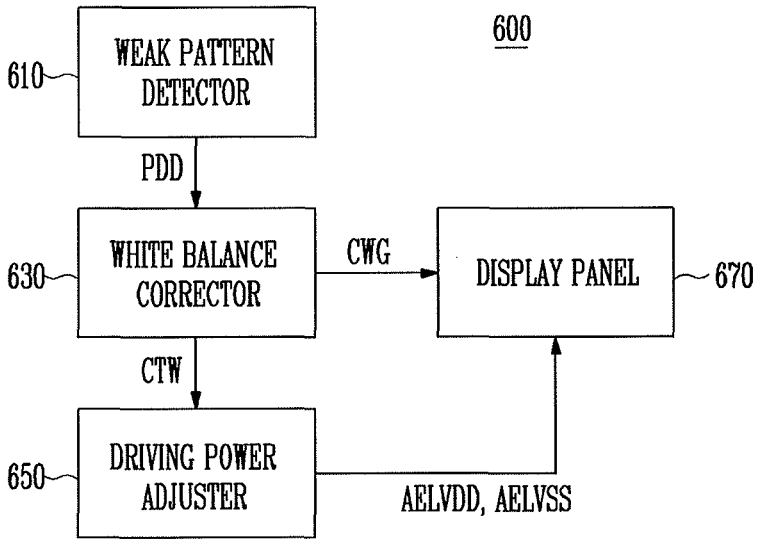
FIG. 10 illustrates a block diagram of an image display device according to an exemplary embodiment of the present disclosure.

FIG. 10 is a block diagram illustrating an image display device according to an exemplary embodiment of the present disclosure.

Referring to FIG. 10, an image display device 600 according to an exemplary embodiment of the present disclosure includes a weak pattern detector 610, a white balance corrector 630, a driving power adjustor 650, and a display panel 670. The display panel 670 includes a plurality of unit pixels, and a plurality of sub pixels within the unit pixel receives driving power from the same driving power line. The weak pattern detector 610 analyzes image data and determines whether the image data is a driving voltage stability weak pattern. The determined result PDD is applied to the white balance corrector 630.

In the exemplary embodiment, the weak pattern detector 610 may divide the image data into a plurality of blocks, calculate a sum of image data loads of the plurality of blocks, and determine that the image data is the driving voltage stability weak pattern when a deviation to the sum of the image data loads for each block is equal to or larger than a predetermined specific value. For example, referring to the image of FIG. 7, the weak pattern detector may divide an entire image into 16 rectangular block areas, and add a data load within a corresponding block area. For example, a block at a left and upper end may have a very low load, and a block at a left and lower end or a right and upper end may have a very high data load. Accordingly, when the sum of the data loads of the respective blocks and a standard deviation of the sum is calculated, a relatively high value may be represented. In this case, the corresponding image data is determined as the driving voltage stability weak pattern. In other words, when the data loads vary widely, the image data is considered to have a driving voltage stability weak pattern, e.g., an unstable pattern.

In another exemplary embodiment, the weak pattern detector 610 may receive a feedback of the voltage applied to the driving power line within the display panel 670, and determine whether image data is a driving voltage stability weak pattern. When a variation range of the voltage applied to the driving power line during the display of the specific image data is large, the corresponding image data may be determined as the driving voltage stability weak pattern.

The white balance correcting unit 630 generates a white balance correction gain CWG, which is varied based on a result of the detection by the weak pattern detector 610. Further, the white balance corrector 630 generates changed target luminance CTW by changing a target luminance. Further, the driving power adjusting unit 650 generates driving power voltages AELVDD and AELVSS, which are changed based on the changed target luminance CTW, and supplies the generated driving power voltages AELVDD and AELVSS to the display panel 670. The display panel 670 displays image data based on the varied white balance correction gain CWG and the changed driving power voltages AELVDD and AELVSS.

Figure 11:
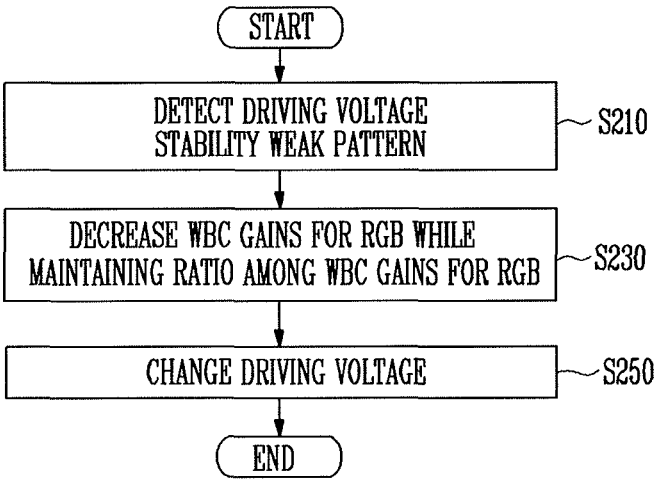
FIG. 11 illustrates a flowchart of an image displaying method according to another exemplary embodiment of the present disclosure.

FIG. 11 is a flowchart illustrating an image displaying method according to another exemplary embodiment of the present disclosure.

Referring to FIG. 11, in an image displaying method according to another exemplary embodiment of the present disclosure, a driving voltage stability weak pattern is detected (S210), a WBC gain for each RGB is decreased while a ratio among white balance correction (WBC) gains for each RGB is maintained (S230). Thus, a driving voltage is changed according to the decreased WBC gains for each RGB (S250). The method of FIG. 11 is different from the method of FIG. 1 in that the change of the target luminance is omitted.

Figure 12:
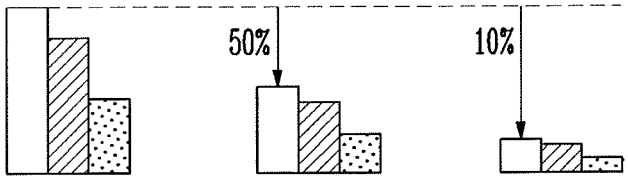
FIG. 12 illustrates a bar graph and a table of a driving voltage when a white balance correction gain is changed and target luminance is variably changed according to an exemplary embodiment of the present disclosure.

FIG. 12 is a graph and diagram illustrating a driving voltage when a white balance correction gain is changed and target luminance is variably changed according to an exemplary embodiment of the present disclosure.

FIG. 12 illustrates a driving voltage ELVDD when a white balance correction gain is decreased to 50%, target luminance is decreased to 90%, and when a white balance correction gain is decreased to 10%, target luminance is decreased to 70%. As illustrated in FIG. 12, it is possible to prevent the driving voltage ELVDD from being excessively increased by appropriately decreasing the target luminance together with the white balance correction gain.

Figure 13:
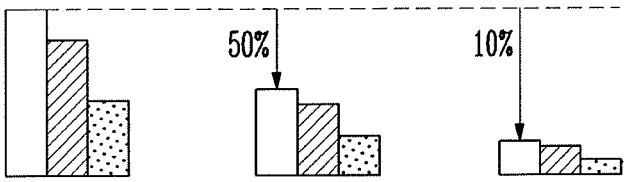
FIG. 13 illustrates a bar graph and a table of a driving voltage when a white balance correction gain is changed and target luminance is fixed according to an exemplary embodiment of the present disclosure.

FIG. 13 is a graph and diagram illustrating a driving voltage when a white balance correction gain is changed and target luminance is fixed according to an exemplary embodiment of the present disclosure. The graph of FIG. 13 is different from the graph of FIG. 12 in that the target luminance is fixedly decreased to 70% regardless of the decrease in the white balance correction gain. Similar to the illustration of FIG. 12, it is possible to prevent the driving voltage ELVDD from being excessively increased by appropriately decreasing the target luminance together with the white balance correction gain.

Figure 14:
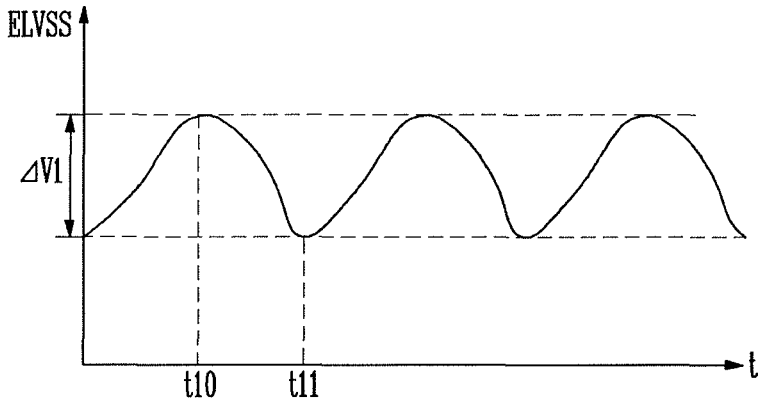
FIG. 14 illustrates a graph of a change in a driving voltage when a white balance correction gain is not changed.
Figure 15:
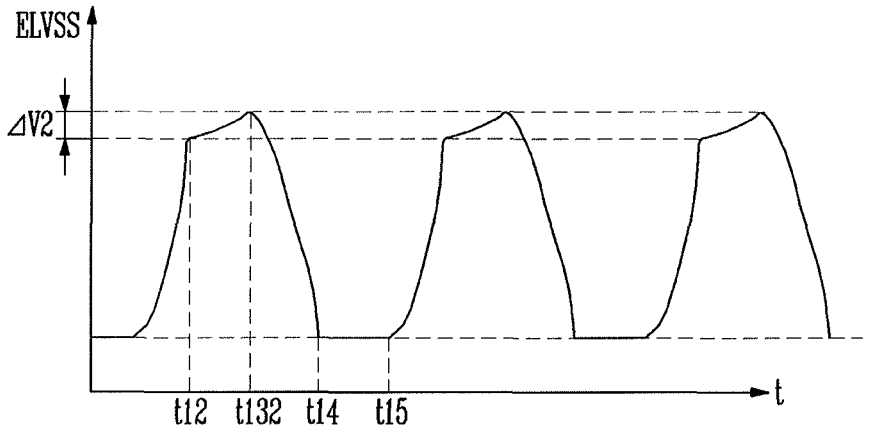
FIG. 15 illustrates a graph of a change in a driving voltage when a white balance correction gain is changed according to an exemplary embodiment of the present disclosure.

FIG. 14 is a graph illustrating a change in a driving voltage when a white balance correction gain is not changed. FIG. 15 is a graph illustrating a change in a driving voltage when a white balance correction gain is changed according to an exemplary embodiment of the present disclosure. In FIG. 15, a period t14 to t15 is a non-emission period, which is additionally generated according to a change in the white balance correction gain.

Referring to FIG. 14, when a white balance correction gain is not changed, the driving voltage ELVSS has a variation range by ΔV1. In contrast, referring to FIG. 15, when the white balance correction gain is changed according to the exemplary embodiment of the present disclosure, the driving voltage ELVSS has a relatively decreased variation range of ΔV2. Accordingly, a color deviation phenomenon may be prevented or reduced.

Figure 16:
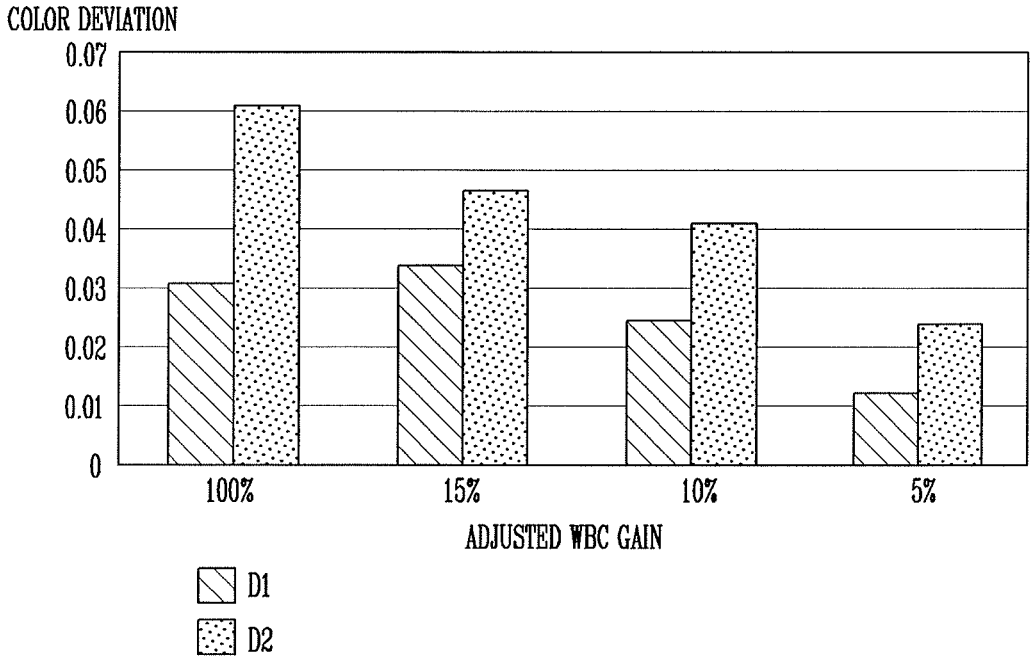
FIG. 16 illustrates a bar graph of a color deviation when a white balance correction gain is changed according to an exemplary embodiment of the present disclosure.

FIG. 16 is a graph illustrating a color deviation when a white balance correction gain is changed according to an exemplary embodiment of the present disclosure. FIG. 16 illustrates a color deviation in the direction D1 and the direction D2 when a white balance correction gain for the four-stage ramp image illustrated in FIG. 7 is changed to 15%, 10%, and 5%. As illustrated in FIG. 16, it can be seen that when the white balance correction gain is not changed (100%), a color deviation of 0.06 in the direction D2 and a color deviation of 0.03 in the direction D1 are generated, but when the white balance correction gain is changed to 15%, 10%, and 5%, a color deviation is remarkably decreased.

In this case, a term "~ unit" used in the present exemplary embodiment means a software element or a hardware element, such as a Field Programmable Gate Array (FPGA) or (Application Specific Integrated Circuit) ASIC, and the "~ unit" serves specific functions. However, the term " . . . unit" is not limited to software or hardware. The term "~ unit" may be configured to be present in an addressable storage medium, or to reproduce one or more processors. Accordingly, for example, the term " . . . unit" includes elements, such as software elements, object-oriented software elements, class elements, and task elements, processes, functions, attributes, procedures, sub-routines, segments of a program code, drivers, firmware, a micro code, a circuit, data, a database, data structures, tables, arrays, and variables. The elements and the functions provided by the "~ units" may be combined to the smaller number of elements and "~ units", or be further separated into additional elements and "~ units". In addition, the elements and " . . . units" may be implemented so as to reproduce one or more CPUs within a device or a security multimedia card.

The present disclosure provides a method of displaying an image that may prevent or reduce color deviation when sub pixels within a unit pixel are connected to the same power line and driven. The present disclosure provides an apparatus for displaying an image that may prevent or reduce color deviation when sub pixels within a unit pixel are connected to the same power line and driven.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of displaying an image in a display device, in which a plurality of sub pixels within a unit pixel receives driving power from one driving power line, the method comprising:

determining a white balance correction gain for each sub pixel of the plurality of sub pixels based on the driving power and an original operation point of each sub pixel;

analyzing image data and detecting whether the image data correspond to a driving voltage stability weak pattern; and when the image data is determined as the driving voltage stability weak pattern, decreasing the white balance correction gain of each sub pixel while maintaining a ratio among the white balance correction gains of the sub pixels;

changing a target luminance for displaying the image data; and changing a voltage level of the driving power in accordance with changed target luminance, wherein the white balance correction gain of each sub pixel is a gain to adjust an emission duty of each sub pixel in a frame.

2. The method as claimed in claim 1, wherein detecting the driving voltage stability weak pattern includes:

measuring a voltage change of the driving power supplied to the sub pixels within the unit pixel while displaying the image data, and determining the image data as the driving voltage stability weak pattern when a range of the voltage change is equal to or larger than a predetermined specific value.

3. The method as claimed in claim 1, wherein detecting the driving voltage stability weak pattern includes:

dividing the image data into a plurality of blocks; and calculating a sum of an image load of each of the plurality of blocks; and when a deviation to the sum of the image load calculated for each block is equal to or larger than a predetermined value, determining the image data as the driving voltage stability weak pattern.

4. The method as claimed in claim 1, wherein decreasing the white balance correction gain of each sub pixel includes multiplying the white balance correction gains of the sub pixels and a same factor value.

5. The method as claimed in claim 4, wherein an emission period, for which an emission device of each sub pixel emits light within one frame period, is decreased by decreasing the white balance correction gain.

6. The method as claimed in claim 4, wherein the same factor value is a number larger than 0 and smaller than 1.

7. The method as claimed in claim 1, wherein changing the target luminance for displaying the image data includes decreasing the target luminance generated by the image data.

8. The method as claimed in claim 7, wherein changing the voltage level of the driving power in accordance with the changed target luminance includes decreasing the voltage level in accordance with the decreased target luminance.

9. The method as claimed in claim 1, wherein the sub pixels include a red sub pixel, a green sub pixel, and a blue sub pixel.

10. A display device, comprising:

a display panel including a plurality of unit pixels, in which a plurality of sub pixels within the unit pixels receives driving power from a same driving power line;

a weak pattern detector to analyze image data, and determine whether the image data is a driving voltage stability weak pattern;

a white balance corrector to store a white balance correction gain for each sub pixel of the plurality of sub pixels based on the driving power and an original operation point of each sub pixel and, when the weak pattern detector detects the driving voltage stability weak pattern, change the white balance correction gain applied to each sub pixel and to change target luminance of the image data; and a driving power adjustor to, when the white balance corrector outputs a change target luminance, change a voltage level applied to the driving power line within the display panel based on changed target luminance, wherein the white balance correction gain of each sub pixel is a gain to adjust an emission duty of each sub pixel in a frame.

11. The display device as claimed in claim 10, wherein the weak pattern detector detects the voltage level of the driving line while the image data is displayed on the display panel, and determines the image data as a driving voltage stability weak pattern when a variation range of the voltage level according to a time is equal to or larger than a predetermined specific value.

12. The display device as claimed in claim 10, wherein the weak pattern detector divides the image data into a plurality of blocks, calculates a sum of an image data load for each of the plurality of blocks, and determines the image data as the driving voltage stability weak pattern when a deviation to the sum of the image data load for each block is equal to or larger than a predetermined specific value.

13. The display device as claimed in claim 10, wherein the white balance corrector multiplies the white balance correction gains applied to the sub pixels and the same factor value.

14. The display device as claimed in claim 10, wherein the white balance corrector decreases target luminance of the image data together with multiplying the white balance correction gains and a same factor value.

15. The display device as claimed in claim 14, wherein the driving power adjustor changes a voltage level applied to the driving power line within the display panel based on the decreased target luminance.

16. The display device as claimed in claim 14, wherein an emission period, for which an emission device of each sub pixel emits light within one frame period, is decreased by decreasing the white balance correction gain.

17. The display device as claimed in claim 16, wherein emission periods are decreased by different amounts while maintaining a ratio among the white balance correction gains of the sub pixels.

18. The display device as claimed in claim 14, wherein the same factor value is a number larger than 0 and smaller than 1.

19. The display device as claimed in claim 10, wherein the white balance corrector, when the weak pattern detector detects the driving voltage stability weak pattern, is to decrease white balance correction gains of the sub pixels while maintaining a ratio among the white balance correction gains of the sub pixels.

20. The method as claimed in claim 1, wherein decreasing the white balance correction gain includes decreasing emission periods by different amounts for the sub pixels.

* * * * *